United States Patent [19]

Mader

[11] 4,355,350

[45] Oct. 19, 1982

[54] REFLECTOR FOR USE IN AN ARTIFICIAL LIGHTING DEVICE

[75] Inventor: John J. Mader, Tewksbury, Mass.

[73] Assignee: Polaroid Corporation, Cambridge, Mass.

[21] Appl. No.: 183,105

[22] Filed: Sep. 2, 1980

[51] Int. Cl.[3] ..... F21V 7/00

[52] U.S. Cl. ..... 362/347; 362/3; 350/296

[58] Field of Search ..... 362/347, 3, 16; 350/293, 294, 292, 296

[56] References Cited

U.S. PATENT DOCUMENTS

| | | | |
|---|---|---|---|
| 3,553,705 | 1/1971 | Ondrejka | 362/347 |
| 3,609,332 | 9/1971 | Schindler | 362/347 |
| 4,027,151 | 5/1977 | Bartnel | 350/294 |
| 4,173,036 | 10/1979 | Ferguson | 350/293 |
| 4,194,234 | 3/1980 | Geissler | 362/347 |
| 4,298,909 | 11/1981 | Krieg | 362/17 |

FOREIGN PATENT DOCUMENTS

| | | | |
|---|---|---|---|
| 54-100174 | 8/1979 | Japan | 362/347 |

OTHER PUBLICATIONS

Goldberg et al., "Analysis and Para-Elliptic Reflector", Journal of the Optical Society of America, vol. 39, No. 6, pp. 497-500.

*Primary Examiner*—Donald P. Walsh
*Attorney, Agent, or Firm*—Francis J. Caufield

[57] ABSTRACT

A reflector having a cross-sectional shape in the form of a 7th order polynomial which, when used with an artificial source of illumination of predetermined geometry, projects a beam of illumination having uniform intensity within a given solid angle. The polynomial shape is especially selected to provide a reflected, defocused source image, whose size increases with increasing angular divergence of light rays within the beam to compensate for natural losses in illumination which would otherwise occur as a function of angular divergence of light rays from the source when used without the reflector.

8 Claims, 11 Drawing Figures

REFLECTOR FOR USE IN AN ARTIFICIAL LIGHTING DEVICE

BACKGROUND OF THE INVENTION

1. Field of the Invention

This invention, in general, relates to artificial lighting devices and, in particular, to a reflector for use with a light source to project a beam of illumination having a substantially constant intensity over a predetermined solid angle.

2. Description of the Prior Art

The utilization of reflectors to intercept radiation emanating from a source and redirect such radiation in a controllable manner for the purpose of making more efficient use of the source radiant energy and of achieving preferred distributions in the intensity of illumination falling on a subject from the reflector-source combination is a well-established practice in the optical arts.

Reflector shape is extremely important in determining how much of the source radiation is usefully concentrated on a subject. Spherical reflectors, for example, produce broad spreading beams for general illumination of a subject and have been used for flash and photoflash lamps used as flash or fill-in lights.

Parabolic reflectors, on the other hand, are used mostly to give a fairly parallel beam for illuminating only a part of a subject or for illuminating the whole of a distant object.

Elliptical reflectors provide convergent beams when a source is placed at one of the reflector focal points—the light converges to the other focus. This type of reflector is particularly suitable for use in illuminating relatively small areas such as the negative in an enlarger or projector.

Aside from reflector shape, other factors, such as reflector size and source geometry and placement within the reflector, also influence the performance of lighting devices. In general, large reflectors placed close to a source make more efficient lighting devices than those using smaller reflectors spaced farther from a source. In addition to being less efficient, small curved reflectors having short focal lengths, used in combination with point sources, do not generally provide uniform illumination. This is a serious disadvantage particularly where the size of a lighing device is important and, also, because most practical sources have some finite size and therefore cannot be regarded as point sources. Consequently, as reflector focal length is reduced, the effect of the size of a light source becomes more and more pronounced.

Where uniform lighting is desirable and size is a limitation, it has been the practice to use a light source as compact as possible in conjunction with the largest convenient reflector whose shape has been carefully selected, usually experimentally, to control light so that the intensity of illumination is distributed as uniformly as possible. In addition, it is also known for this purpose to utilize auxiliary optics such as Fresnel lenses and refracting plates to achieve uniformity.

It is a primary object of the present invention to provide a compact artificial lighting device for uniformly illuminating a subject.

Another object of the present invention is to provide a reflector whose shape, when used in conjunction with a point source or an approximate point source, provides a substantially even illumination intensity over a predetermined solid angle.

Yet another object of the present invention is to provide an elongated reflector which, when used with an elongated cylindrical source, provides an illumination distribution whose intensity is substantially constant along at least one line in a plane normal to the general direction along which light is projected from the reflector.

Other objects of the invention will in part be obvious and will in part appear hereinafter. The invention accordingly comprises the apparatus possessing the construction, combination of elements and arrangement of parts which are exemplified in the following detailed disclosure.

SUMMARY OF THE INVENTION

This invention, in general, relates to artificial lighting devices and, in particular, to a reflector which, when used in combination with a light source of predetermined geometry, projects a beam of illumination having a substantially constant intensity over a predetermined solid angle.

The invention accordingly comprises an artificial lighting assembly which includes an artificial source of illumination having predetermined geometry.

Further included is a concave, open-ended reflector that is rotationally symmetric about a given axis and has a cross-sectional shape in the form of a 7th order polynomial curve given by the equation:

$$Y = \sum_{n=0}^{7} A_n X^n$$

where Y and X are, respectively, the dependent and independent variables in a Cartesian coordinate system and the terms, $A_n$, represent the coefficients of the polynomial. The polynomial curve has a radius of curvature, and hence optical power, which progressively changes in a gradual manner without discontinuities with distance along the curve. The curve is shaped so that the radius of curvature thereof increases with increasing distance from the apex thereof so as to reduce the optical power of the reflector in a predetermined manner with increasing distance along the curve.

Means are also included for positioning the source within the reflector in a predetermined manner to project a beam of illumination of predetermined solid angle that is rotationally symmetric about the reflector axis of symmetry. The projected beam illuminates any plane, normal to the reflector axis of symmetry, spaced ahead of the assembly, and within the beam angle of the divergence and effective range, in a substantially uniform manner over another solid angle that is smaller than the solid angle of the beam of illumination. The reflector operates to reflect light from the source in a manner whereby the intensity of the light reflected from the reflector progressively increases in a gradual manner, without discontinuities, in accordance with increasing angular divergence of light rays within the beam as measured away from the reflector axis of symmetry such that the intensity of illumination of points on any normal plane, which points are away from the reflector axis of symmetry, is increased to compensate for natural losses in direct illumination from the source which would otherwise be present at those same points absent the reflector and to abruptly cause a reduction in the intensity of illumination of light traveling at angles, as measured with respect to the reflector axis of symmetry, which are greater than the other smaller solid angle over which the intensity of the illumination of the beam is substantially constant.

The cross-sectional shape of the invention can also be incorporated in an elongated concave reflector that is bilaterally symmetric about a plane to project a beam of illumination, when used with an elongated source, that is bilaterally symmetric about the reflector plane of symmetry.

DESCRIPTION OF THE DRAWINGS

The novel features that are considered characteristic of the invention are set forth with particularly in the appended claims. The invention itself, however, both as to its organization and method of operation together with other objects and advantages thereof will best be understood from the following description of the illustrated embodiment when read in connection with the accompanying drawings wherein like numbers have been employed in the different figures to denote the same parts and wherein:

DESCRIPTION OF THE PREFERRED EMBODIMENT

This invention, in general, relates to artificial lighting apparatus and, in particular, to a reflector which, when used in conjunction with a light source of predetermined geometry in such apparatus, provides a beam of illumination whose intensity is substantially constant over a predetermined solid angle.

Figure 1:
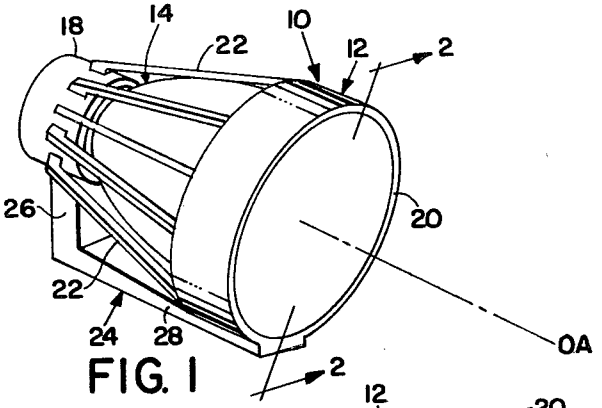
FIG. 1 is a perspective view of the artificial lighting apparatus incorporating the reflector of the invention.
Figure 2:
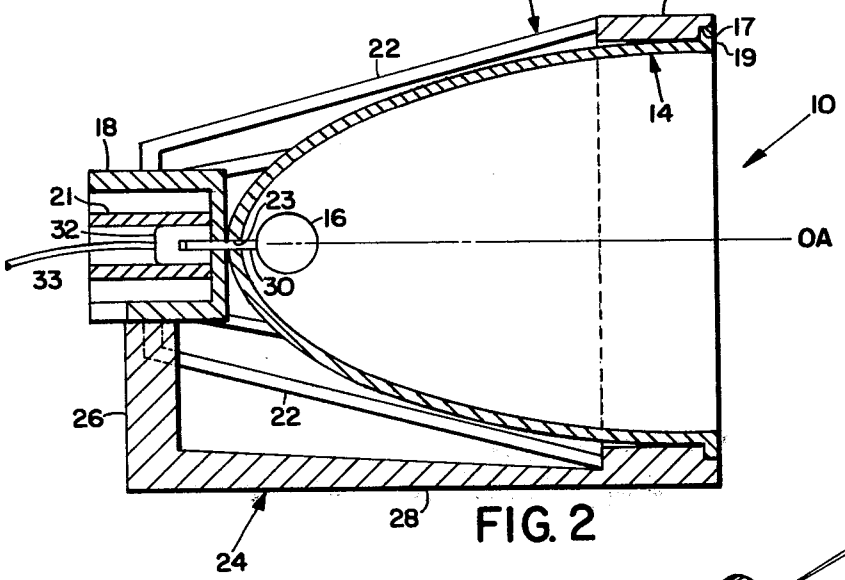
FIG. 2 is a cross-sectional view of the apparatus of FIG. 1 taken generally along line 2—2 of FIG. 1.

Referring now to FIGS. 1 and 2, there is shown at 10 an artificial lighting apparatus having incorporated therein a reflector 14 structured in accordance with the teachings of the invention as described hereinafter. The apparatus 10 further comprises a generally conical shaped reflector support element or member 12 in which the reflector 14 is disposed and an artificial light source 16 which is disposed within the reflector 14.

The reflector support element 12 comprises a pair of concentric cylindrical rings including a ring 20 (FIG. 2) behind which is spaced a smaller diameter ring 18. Connecting the rings, 18 and 20, are a plurality of elongated bars 22 that are angled with respect to the axis, OA, and have their opposite ends attached to and equally spaced around respective outer circumferences of the rings, 18 and 20. Structured in the foregoing manner, the element 12 comprises a cage-like structure adapted to receive and support therein the reflector 14.

The cage-like element 12 sits atop an L-shaped bracket 24 which has a vertically extending leg 26 connected with the bottom of the ring 18 and a horizontally extending leg 28 which is connected to the bottom of the ring 20.

As can be seen in FIG. 2, the forward end of the ring 20 includes a circumferential groove 17 that is adapted to receive a flange 19 which surrounds the open end of the reflector 14, and radially extends outwardly therefrom The reflector flange 19 can be permanently secured within the circumferential groove 17 in a well-known manner to support the reflector 14 within the cage-like element 12 in cantilevered fashion.

Located within the ring 18 is a tube 21 that is selectively shaped to receive a receptacle 32 that is located on the end of an electrical power cord 33. Receptacle 32 slides into the tube 21 and is fixedly seated therein in a well-known manner. Electrodes, such as that designated at 30 in FIG. 2, from the source 16 extend through an aperture 23 located near the apex of the reflector 14 and thereafter fit into the receptacle 32 for purposes of supplying power to the light source 16 and, as well, to facilitate location of the light source 16 within the reflector 14 in a predetermined manner.

The light source 16 as illustrated represents a small spherical source which can be a tungsten type having a filament surrounded by a frosted glass envelope. However, the type of light source is not critical in terms of the optical cooperation between the source geometry and the reflector 14 and therefore other light source would work equally as well in the apparatus 10. Other sources which would be appropriate could include strobe lights whose geometry approximated that of a small sphere. In addition, point sources or sources which are nearly points would also be appropriate.

It will be recognized that the light source 16 radiates light in all directions and for this reason behaves as a small, but finite, spherical source which naturally radiates energy in a uniform manner to illuminate a very large solids angle, $2\pi$ steridians or nearly so. Therefore, when it is desired to illuminate a solid angle smaller than $2\pi$ steridians, such as an angle subtended by a subject located in a plane perpendicular to a line extending from the center of the source and intersecting the plane, much of the radiant energy emanating from the source 16 would naturally not be utilized. However, to make more effective use of the radiant energy which is available from the source 16, the reflector 14 is provided.

Figure 3:
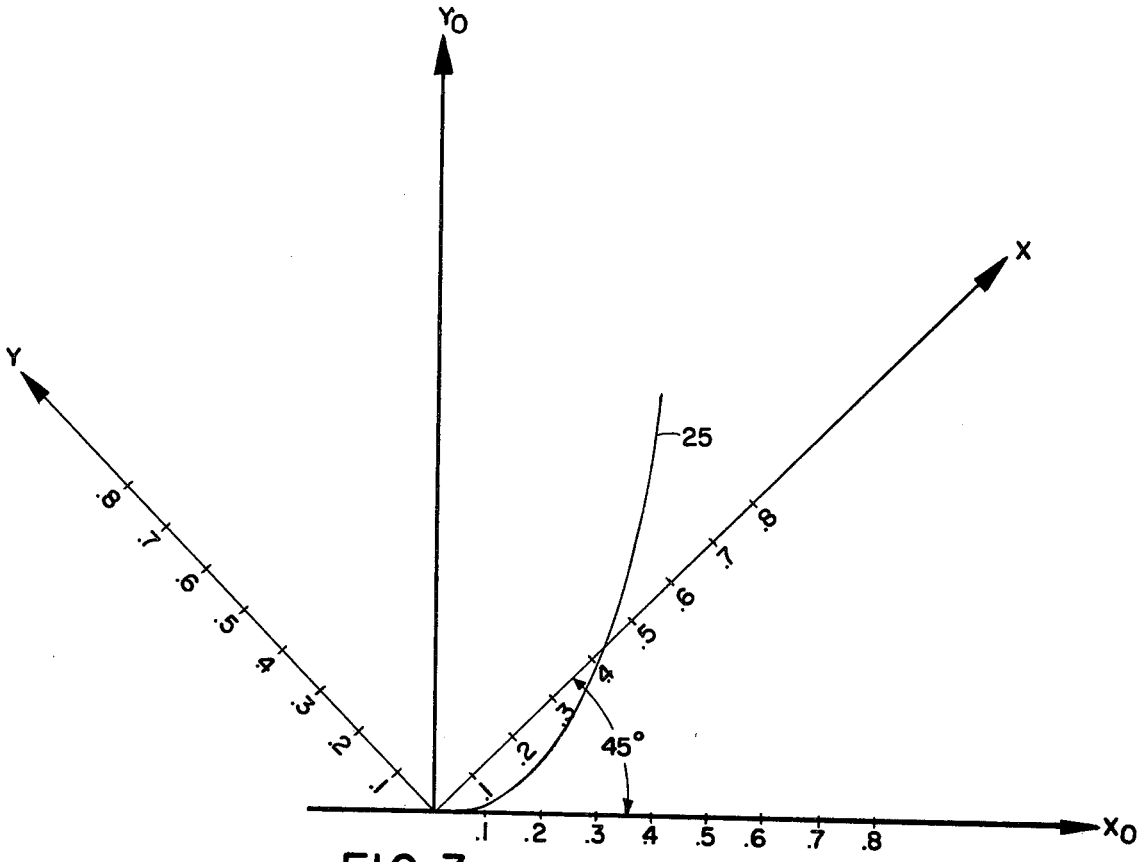
FIG. 3 is a graph giving the shape of the reflector of the invention in a Cartesian coordinate system.

The reflector 14 is a concave, open-ended type of reflector that is rotationally symmetric about the axis, OA, and has a cross-sectional shape which was determined in a manner and for reasons which will be subsequently explained. The cross-sectional shape of the reflector 14 is preferably in the form of a 7th order polynomial curve which is shown at 25 in FIG. 3 and given by the equation:

$$Y = \sum_{n=0}^{7} A_n X^n$$

where Y and X are, respectively, the dependent and independent variables in a Cartesian coordinate system and the terms $A_n$, represent coefficients of the polynomial. The values of the coefficients, $A_n$, are, for $X \geqq 0$, as follows:

$A_0 = 0.0$
$A_1 = -1.0473509$
$A_2 = 6.074585$
$A_3 = -20.471872$
$A_4 = 47.502146$
$A_5 = -63.91636$
$A_6 = 45.333022$
$A_7 = -13.07712$ when the Cartesian coordinate system in which the polynomial is given (X-Y) is rotated by 45° with respect to a reference system, $X_0$-$Y_0$, as shown in FIG. 3.

Figure 4:
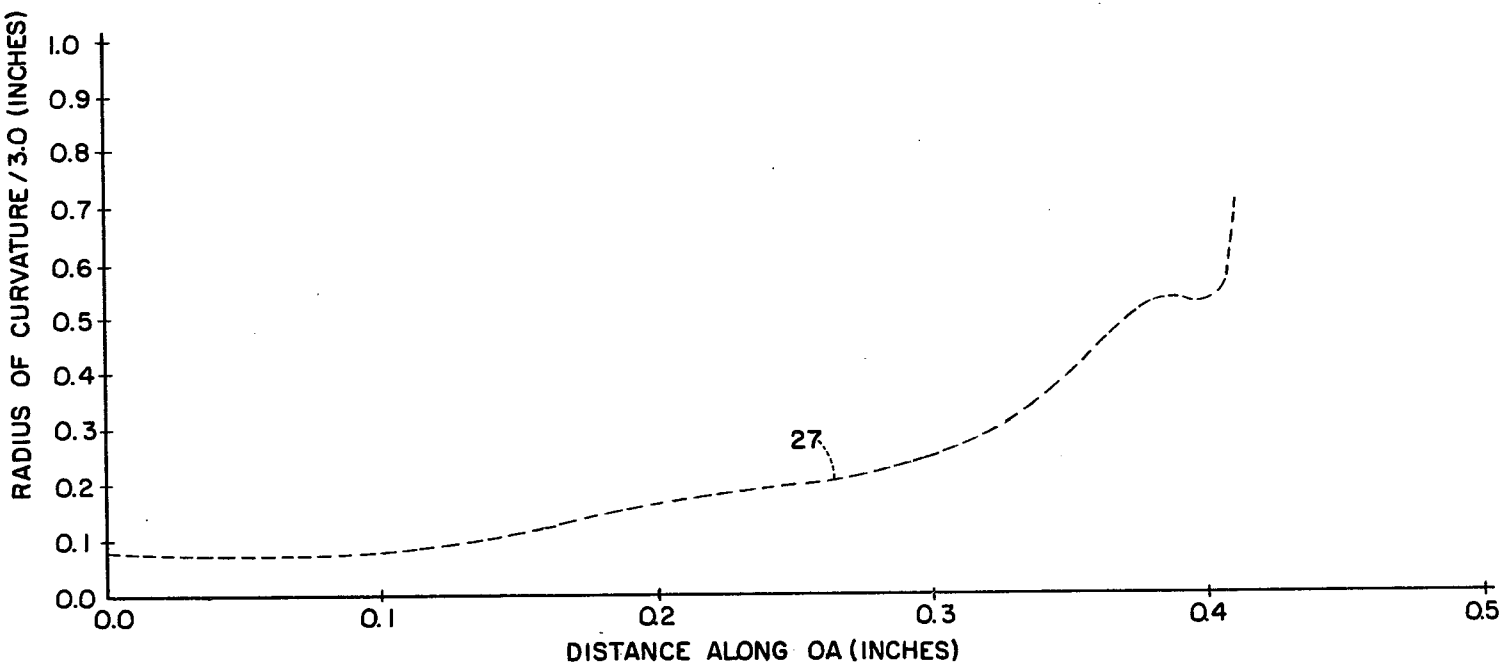
FIG. 4 is a graph showing the local radius of curvature of the curve of FIG. 3.

The radius of curvature for the curve 25 representing the shape of the reflector 14 is shown in FIG. 4 as the curve 27. The local optical power of the reflector 14, which depends on the radius of curvature, progressively changes in a gradual manner without discontinuities with distance along the curve. The curve 25 is shaped so that the radius of curvature thereof increases with increasing distance from the apex thereof so as to reduce the optical power of the refector 14 in a predetermined manner with increasing distance along the curve 25.

For the foregoing reflector shape, the radius of the spherical source 16 is selected to be 0.05 inches and the source 16 is spaced ahead of the apex of the reflector 14, along the axis, OA, by a distance of 0.040 inches.

The rotationally symmetric shape of the reflector 14, in combination with the geometry and location of the light source 16, operates to provide a beam of illumination that is rotationally symmetric about the axis, OA, and has a distribution in the intensity of its illumination which is substantially constant over a predetermined solid angle. This will best be understood by describing, in conjunction with the diagram of FIG. 5, a method by which the characteristic distribution of illumination intensity for the apparatus 10 can be measured and characterized.

Figure 5:
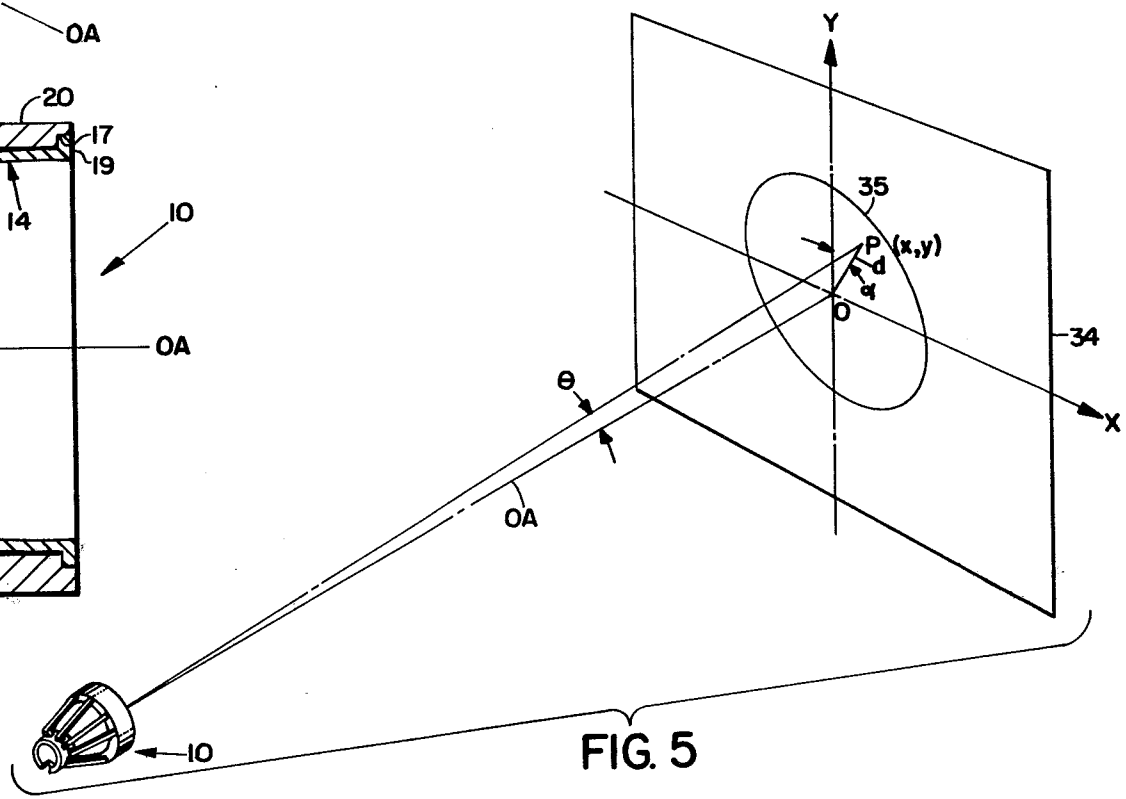
FIG. 5 is a diagrammatic perspective view of the apparatus of FIG. 1 positioned forwardly of a normal plane on which the intensity of illumination provided by the apparatus of FIG. 1 can be measured.

Referring now to FIG. 5, the artificial lighting apparatus 10 is shown positioned forwardly of a plane defined by an orthogonal coordinate system (X-Y axis) whose origin, O, is coincidental with the axis, OA. The plane thus defined is arranged normal to the axis, OA, and is preferably spaced away from the lighting apparatus 10 by a distance which is representative of one of the distances over which the lighting apparatus 10 is expected to be used for purposes of illuminating subjects located ahead of it. For photographic purposes, for example, the distances over which the lighting apparatus 10 might reasonably be expected to be used could be between 3 and 20 feet. Delineated on the normal plane is a circle 35 which generally defines the area on the normal plane that is expected to be uniformly illuminated by the lighting apparatus 10 when the lighting apparatus 10 is spaced ahead of the normal plane by a predetermined distance. Conventionally, the Y-axis on the normal plane corresponds to vertical orientation while the X-axis corresponds to the horizontal.

Once the normal plane is defined and the area which is to be illuminated is established on it, photointegrators (not shown) are placed on the normal plane at equally spaced apart points surrounding its origin, O. The lighting apparatus 10 is then energized, the light flux falling at each point is measured in conventional units such as meter candles (or meter-candle-seconds in the case of a transient source) and the resultant data tabulated in a form convenient for graphical presentation. For example, the location of a point, P (X, Y) can be expressed in terms of its distance, d, from the origin O and an angle, $\alpha$, which is the angle between a line drawn from the origin, O, to the point P and Y-axis or by the angle, $\alpha$, and a semi-field angle, $\theta$, which is the angle between the axis, OA, and a line drawn from the center of the open end of the reflector 14 to the point, P (X, Y). Either convention for describing all points on the normal plane is acceptable.

Figure 6:
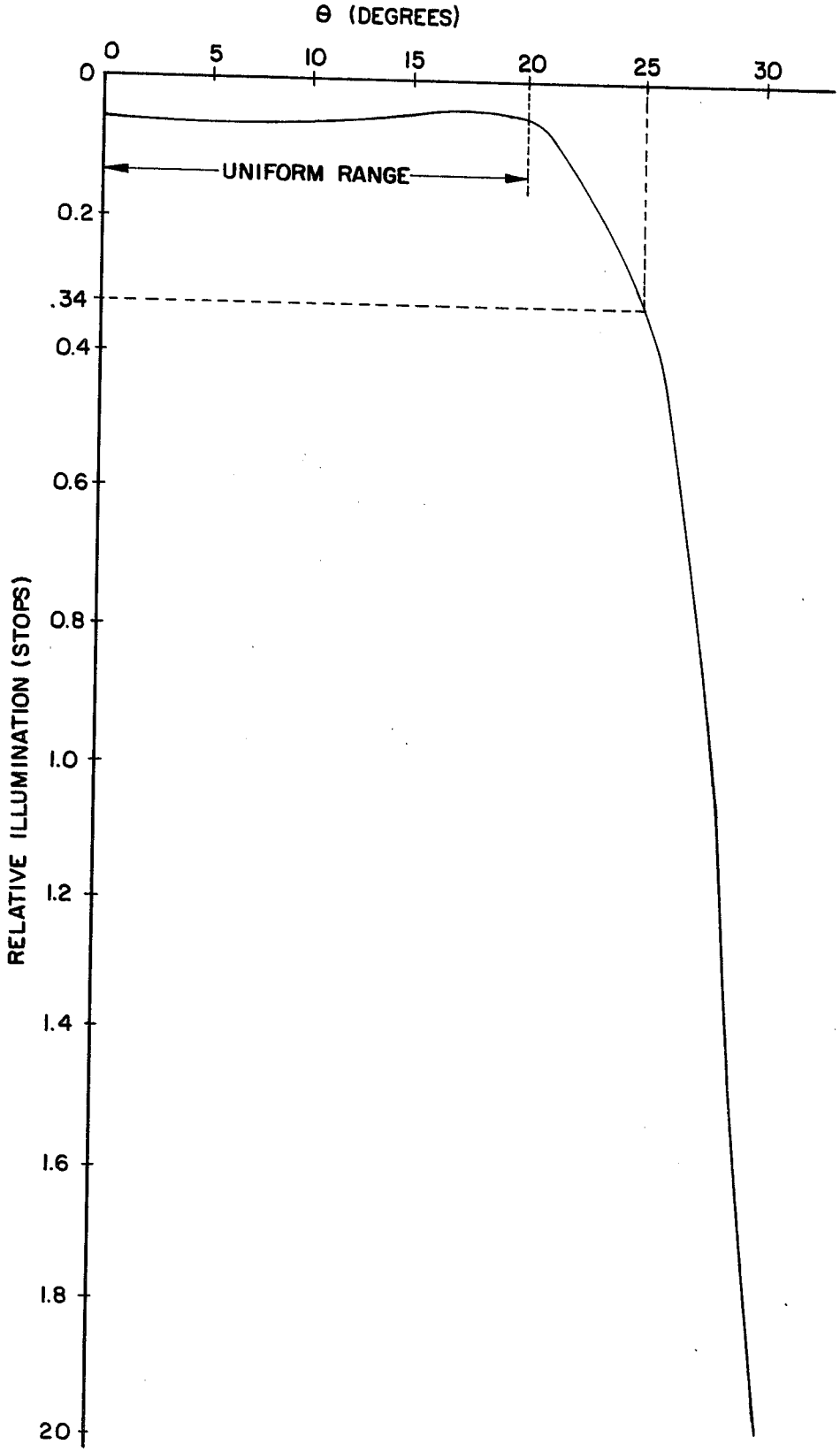
FIG. 6 is a graph showing the intensity of illumination as a function of angular field position along any line of the normal plane of FIG. 5.

The distribution and the intensity of the illumination of a beam provided by the apparatus 10 for its foregoing configuration, measured in the foregoing manner on a normal plane spaced approximately 5 feet forward of the lighting apparatus 10 is presented in FIG. 6. Because the beam provided by the apparatus 10 is rotationally symmetric about the axis, OA, the curve in FIG. 6 represents the variation in intensity of the illumination over the normal plane as a function of semi-field angle, $\theta$, for points along any line radiating outwardly from the normal plane origin, 0, in any direction, $\alpha$. The variation in intensity, i.e., the ordinate in FIG. 6, represents the difference in the intensity of illumination, expressed in stops, for different points along any radial line from the origin, 0, as compared to the peak intensity of illumination measured on the normal plane. Thus, for example, the illumination of a point on the normal plane whose position is specified by the semi-field angle, $\theta$, equal to 25° would be approximately −0.34 stops lower in intensity than the peak intensity recorded on the normal plane. Moreover, since the beam of illumination provided by the apparatus 10 is rotationally symmetric about the axis, OA, all points on the normal plane having a coordinate, $\theta$, equal to 25° are equally intense. The calculations for arriving at the relative illumination expressed in stops were made in accordance with the following equation:

$$\text{Relative Illumination (stops)} = \log_2 \frac{\text{(Measured intensity)}}{\text{(Measured peak intensity)}}.$$

As will be appreciated from FIG. 6, the lighting apparatus 10 projects a beam of illumination of a predetermined solid angle which corresponds approximately to a semi-field angle of 30° and, within that beam angle of divergence, it can be seen that there is another solid angle which is approximately at 20° over which the intensity of the beam of illumination is substantially uniform.

It is apparent that the shape of the reflector 14 operates to reflect light from the source 16 in a manner whereby the intensity of the reflected light progressively increases in a gradual manner, without discontinuities, in accordance with increasing angular divergence of light rays within the beam as measured away from the reflector axis of symmetry, OA, such that the intensity of illumination of points on any normal plane, spaced away from the reflector axis of symmetry, OA, is increased to substantially compensate for natural losses in direct illumination from the source 16 which would otherwise be present at those same points absent the reflector 14. In addition, the reflector 14 abruptly causes a reduction in the intensity of the illumination of light traveling at angles, as measured with respect to the reflector axis of symmetry, OA, which angles are greater than 20°.

The shape for the reflector 14 for the particular illumination distribution pattern described above can be arrived at by utilizing a computer algorithm which accepts the geometry of the lighting problem, i.e., the light source 16 spaced ahead of the normal plane by a predetermined distance. The normal plane is divided into a series of zones whose areas were made to be proportional to the losses in natural light which were assumed to obtain as a result of the geometry of the lighting arrangement. Rays of light are then traced from the source 16 and allowed to reflect from a generalized 7th order polynomial shaped reflector whose local slope can be continuously changed. The projection of the light rays from the generalized reflector onto the various zones of the normal plane are then traced and an accounting of how many rays impinged on each zone from diffrent portions of the reflector is then made. The process is continued changing polynomial shape until, at the insistence of the algorithm, a polynomial shape is determined which results in the uniform distribution of intensity already described.

Figure 7:
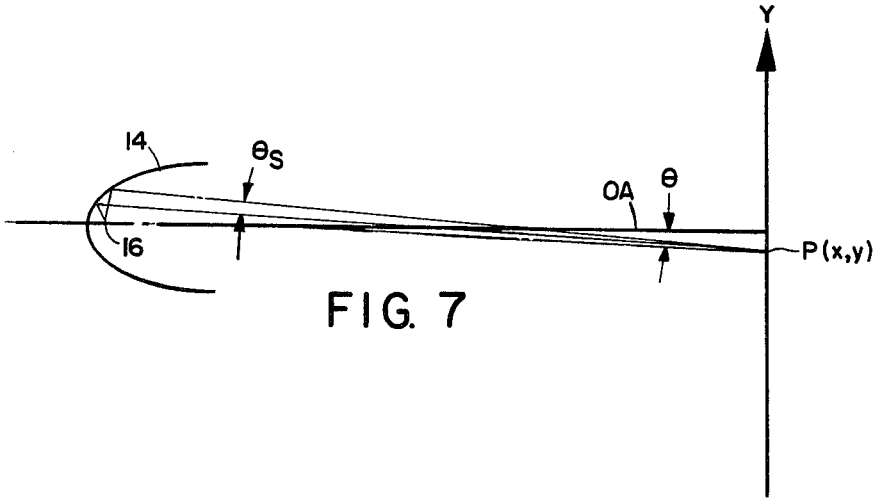
FIGS. 7, 8, and 9 are diagrammatic drawings indicating how representative light rays from the source of the apparatus of FIG. 1 are directed by different parts of the reflector of the invention.
Figure 8:
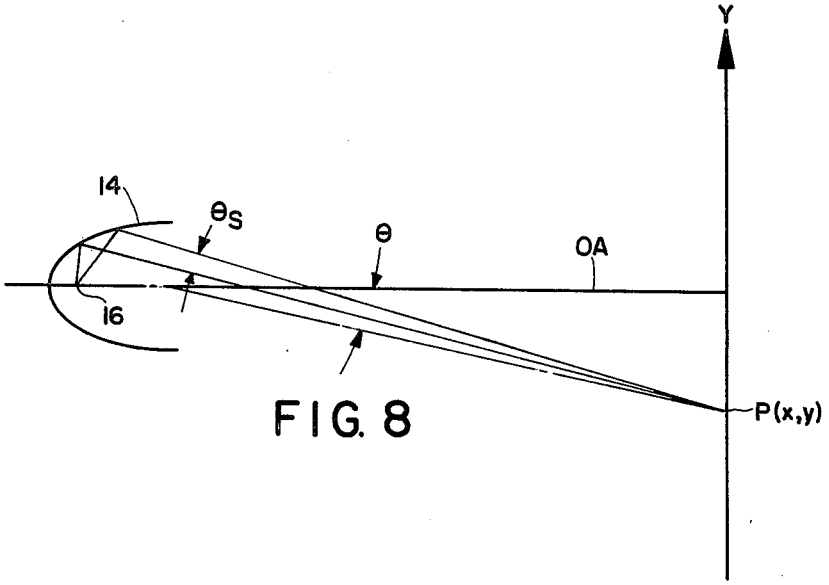
Figure 9:
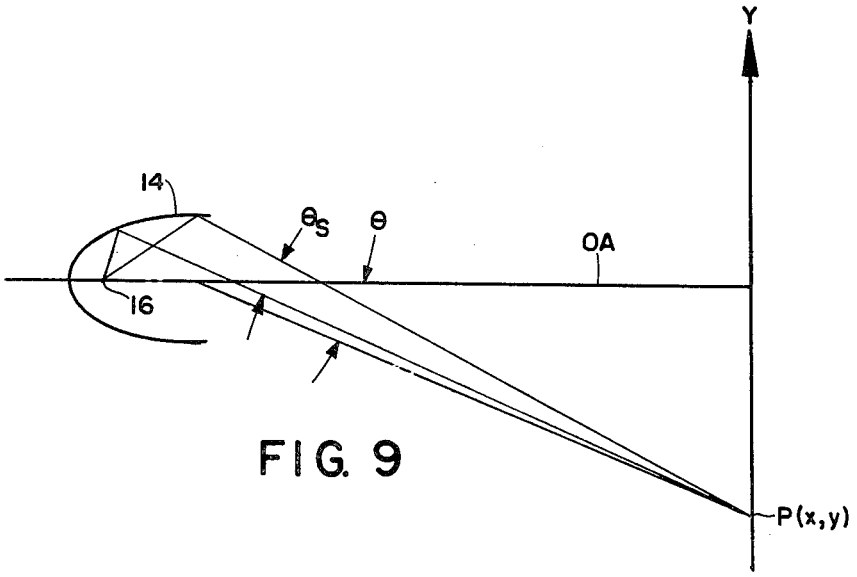

The manner in which the lighting apparatus 10 provides the illumination distribution pattern illustrated in FIG. 6 may further be understood by now referring to FIGS. 7, 8, and 9 which diagrammatically illustrate the path which rays from the center of the light source 16 take to different semi-field positions, P (X, Y), designated by the angle, $\theta$, after those rays are reflected from different portions of the reflector 14. The figure in FIG. 7 illustrates that the smaller radii of curvature of the reflector 14, which are located near the apical region of the reflector 14, operate to control radiation emanating from the light source 16 in regions which are near the axis, OA. FIG. 9 illustrates that the largest radii of curvature of reflector 14, which are located near the open end of reflector 14, operate to control radiation near the extreme edges of the beam of illumination provided by the apparatus 10 and intermediate radii of curvature, shown diagrammatically in FIG. 8, operate to control radiation in regions of the beam of illumination intermediate the extreme angle of the beam of illumination and the center of the beam.

Figure 10:
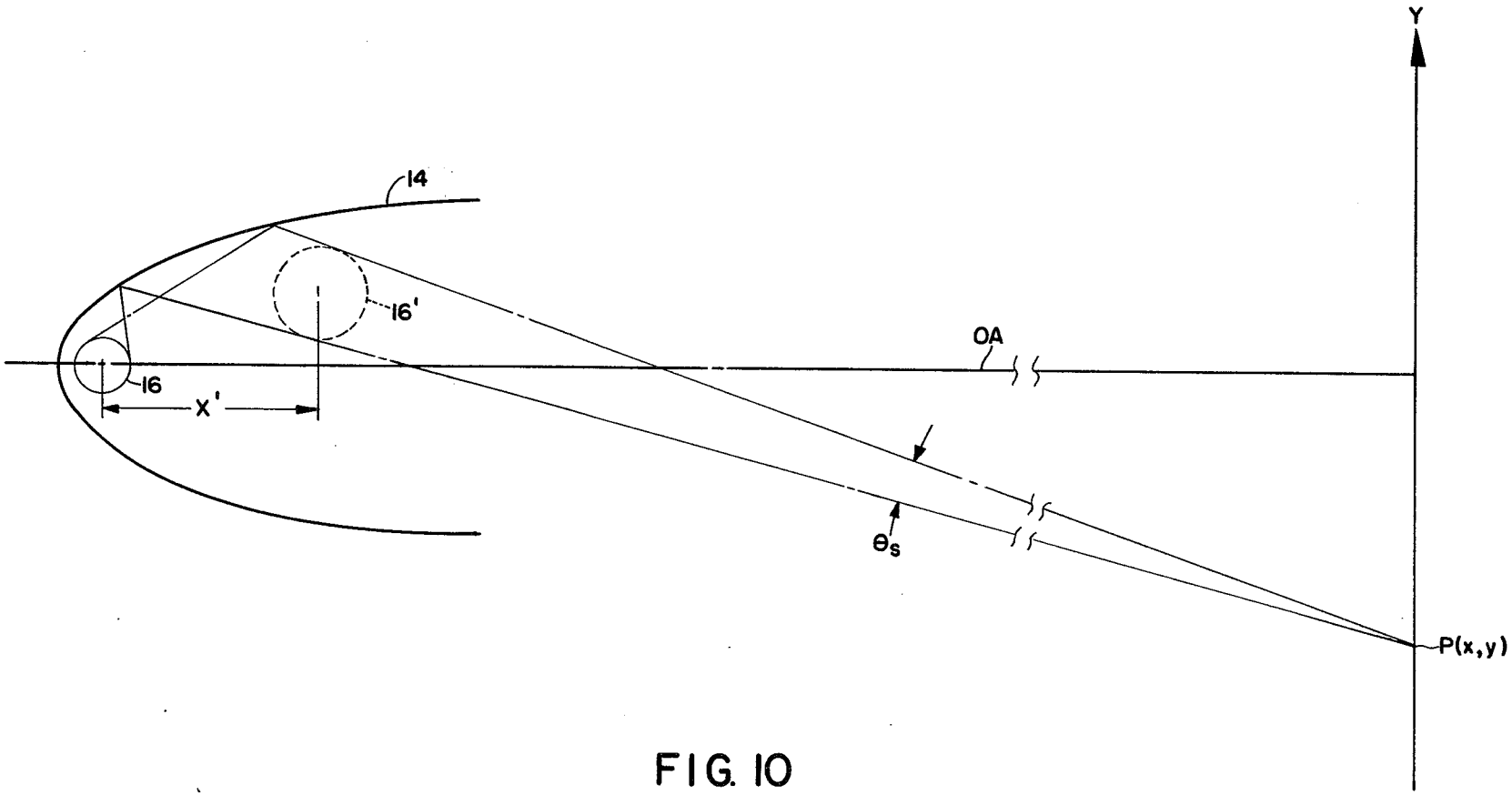
FIG. 10 is a diagrammatic drawing illustrating a reflected source image formed by the reflector of the apparatus of the invention.

As can be readily appreciated, (see FIG. 10) the intensity of the illumination of a point, P(x,y), in the normal plane can be considered to consist of two separate components—the illumination from light traveling from the source 16 directly to the point and the illumination from the source as directed to a point by the reflector 14.

The direct illumination component decreases as the distance between the point, P(x,y), and the axis, OA, increases. This is a consequence of the inverse square law governing the illumination of a plane by an approximate point source, and the differences in direct illumination between a point, P(x,y), located on the axis, OA, and points, P(x,y), located away from the axis, OA, are referred to as natural losses in direct illumination. These natural losses are compensated for, substantially exactly, by the reflected illumination component provided by the reflector 14 of this invention so that the illumination provided by the apparatus 10 is substantially constant over the predetermined solid angle of approximately 20 degrees.

The manner in which the reflector of this invention compensates for the natural losses may be understood by considering the imaging properties of the reflector 14 and how those properties contribute to the illumination of a point, P(x,y) located away from the axis, OA. In general, the illumination of a point, P(x,y), due to the reflected component, depends on the reflectivity of the reflector surface, the size and location of the reflected image of the source 16, and the solid angle, $\theta_s$, subtended by the image of the source 16 as seen from a point, P(x,y).

The concave shape of the reflector 14 and the proximity of the source 16 to the reflector 14 operate to form reflected defocused source images whose size and location change as a consequence of the reflector shape and depending on the angle, i.e. the point P(x,y), from which the apparatus 10 is viewed. One such image is shown diagrammatically in FIG. 10 at 16'. As can be seen, the image 16' is shifted forward of the source 16, along the axis, OA, by a distance, x', and is also magnified. In general, all of the source images formed by the reflector 14 will be thus shifted and enlarged and can be considered to be nearly equal in intensity to the actual source 16 if the reflectivity of the surface of the reflector 14 is reasonably high, say 95%.

As indicated by the representative distance, x', all of the source images formed by the reflector 14 are located near the position of the actual source 16. The distance over which these source images are viewed from the points, p(x,y), are quite large in comparison to the amount by which the source images are displaced from the actual source position. Therefore, the source images can practically be considered to originate from the actual source location. When the source images are considered to be nearly as intense as the source itself and are considered to be located near the actual source 16, the solid angle, $\theta_s$, subtended by the image as seen from any point, P(x,y) can be considered to vary as a function of only the size of the source image and the reflected illumination at any point P(x,y) consequently becomes a function of the solid angle, $\theta_s$. The gradual change in the optical power of the reflector 14 operates to gradually increase the size of the defocused source images when viewed from locations further off-axis and therefore the solid angle, $\theta_s$, and consequently the illumination, progressively increases in a gradual manner in accordance with increasing angular divergence of light rays, within the beam of illumination provided by the apparatus 10, as measured away from the reflector axis of symmetry, OA. The shape of the reflector 14 is selected so that the reflected illumination component compensates substantially exactly for the natural losses and when added to the direct illumination component results in the uniform illumination distribution of the apparatus 10.

Figure 11:
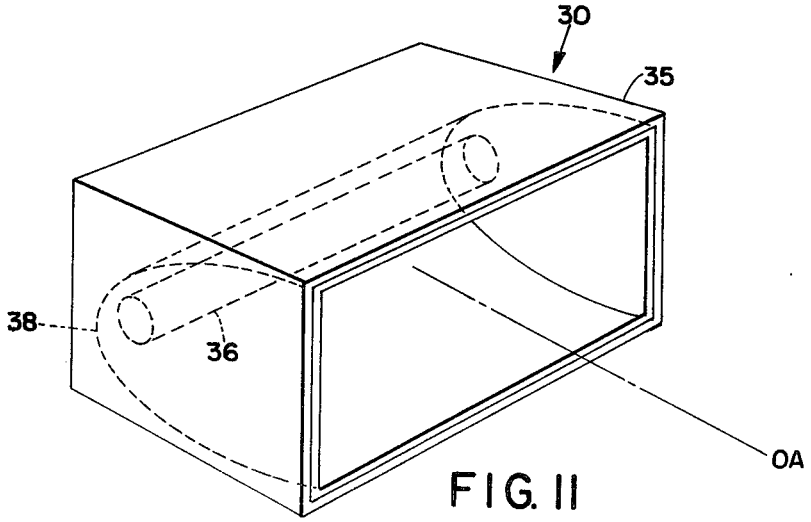
FIG. 11 is a perspective view of another artificial lighting apparatus in which is incorporated an elongated, bilaterally symmetric version of the reflector of the invention.

The cross-sectional shape of the reflector of the invention may also be used in a bilaterally symmetric configuration as, for example, that illustrated in the lighting apparatus designated at 30 in FIG. 11. The lighting apparatus 30 comprises a housing 35 in which is disposed an elongated cylindrical source of artificial illumination 36 of given length and diameter. The source 36 can, for example, be a conventional electronic strobe tube. Surrounding the strobe tube 36 is a concave, open-ended reflector 38, that is bilaterally symmetric about a horizontal plane containing the axis, OA. The reflector 38 is of given width and has the same cross-sectional shape which was previously discussed in connection with the reflector 14.

The strobe tube 36 is positioned within the reflector 38 in a predetermined manner through the use of conventional fastening arrangements for such devices.

The apparatus 30 thus structured projects a beam of illumination of predetermined angular divergence, as measured in the reflector plane of symmetry and a plane orthogonal thereto to illuminate any plane normal to the reflector plane of symmetry, spaced ahead of the apparatus 30 and within its beam angle of divergence and effective range, with a preferential distribution of illumination thereover. The cross-sectional shape of the reflector 38 operates to control the distribution in the intensity of the illumination of the beam provided by the apparatus 30 along vertical lines in the normal plane which, in FIG. 5, are lines parallel to the Y-axis. The intensity of the illumination along lines parallel to the X-axis in FIG. 5 change as though the reflector 38 were not present and instead were illuminated by the elongated flash tube 36 having a plane mirror located behind it. Thus, the intensity of the illumination provided by the apparatus 30 would only be substantially constant along the Y-axis of FIG. 5 and over a semi-field angle of approximately 20°. The intensity of the illumination along other vertical lines, parallel to the Y-axis in FIG. 5, is diminished in amplitude the further such lines are spaced away from the Y-axis and further modified because of the plane mirror effect previously discussed.

Certain changes may be made in the above-described embodiments without departing from the scope of the invention and those skilled in the art may make still other changes according to the teachings of the disclosure. Therefore, it is intended that all subject matter contained in the above description or shown in the accompanying drawings shall be interpreted as illustrative and not in a limiting sense.

I claim:

1. An artifical lighting assembly comprising:

an artifical source of illumination having spherical geometry;

a concave, open-ended reflector that is rotationally symmetric about a given axis and has a cross-sectional shape in the form of a 7th order polynomial curve given by the equation:

$$Y = \sum_{n=0}^{7} A_n X^n$$

where Y and X are, respectively, the dependent and independent variables in a Cartesian coordinate system and the terms, $A_n$, represent the coefficients of said polynomial and are nonzero for the first through seventh order terms, said polynomial curve having a radius of curvature, and hence optical power, which progressively changes in a gradual manner without discontinuities with distance along said curve, said curve being shaped so that the radius of curvature thereof increases with increasing distance from the apex thereof so as to reduce the optical power of said reflector in accordance with increasing distance along said curve; and means for positioning said source within said reflector in a predetermined manner to project a beam of illumination of predetermined solid angle that is rotationally symmetric about said reflector axis of symmetry to illuminate any plane normal to said reflector axis of symmetry, spaced ahead of said assembly and within said beam angle of divergence and effective range, in a substantially uniform manner over another solid angle that is smaller than said solid angle of said beam of illumination, said reflector operating to reflect light from said source in a manner whereby the intensity of the light reflected from said reflector progressively increases in a gradual manner, without discontinuities, in accordance with increasing angular divergence of light rays within said beam as measured away from said reflector axis of symmetry such that the intensity of illumination of points on any normal plane, which points are spaced away from said reflector axis of symmetry, is increased to compensate substantially exactly for natural losses in direct illumination from said source which would otherwise be present at those same points absent said reflector and to abruptly cause a reduction in the intensity of the illumination of light traveling at angles, as measured with respect to said axis of symmetry, which are greater than said other smaller solid angle.

2. The lighting assembly of claim 1 wherein the coefficients of said polynomial are given by:

$A_0 = 0.0$
$A_1 = -1.0473509$
$A_2 = 6.074585$
$A_3 = -20.471872$
$A_4 = 47.502146$
$A_5 = -63.91636$
$A_6 = 45.333022$
$A_7 = -13.07712$ where said polynomial is specified in a Cartesian coordinate system that has been rotated by 45° and $X \geqq 0$.

3. The assembly of claim 2 wherein said source is of radius 0.05 inches and has its center located on said reflector axis of symmetry a distance of 0.040 inches forward of the apex of said reflector.

4. An artificial lighting assembly comprising:

an elongated cylindrical source of artificial illumination of given length and diameter;

a concave, open-ended reflector, bilaterally symmetric about a plane, said reflector being of given width and having a cross-sectional shape in the form of a 7th order polynomial curve given by the equation:

$$y = \sum_{n=0}^{7} A_n x^n,$$

where Y and X are, respectively, the dependent and independent variables in a Cartesian coordinate system and the terms, $A_n$, are the coefficients of said polynomial and are nonzero for the first through the seventh order terms, said polynomial curve having a radius of curvature, and hence optical power, which progressively changes in a gradual manner with distance along said curve, said curve being shaped so that the radius of curvature thereof increases with increasing distance from the apex thereof so as to reduce the optical power of said reflector in accordance with increasing distance along said curve; and means for positioning said source within said reflector in a predetermined manner to project a beam of illumination of predetermined angular divergence, as measured in said reflector plane of symmetry and a plane orthogonal thereto, to illuminate any plane normal to said reflector plane of symmetry, spaced ahead of said assembly and within said beam angle of divergence and effective range, with a preferential distribution of illumination thereover, said reflector operating to reflect light from said source in a manner whereby the intensity of light reflected from said reflector progressively increases in a gradual manner without any discontinuities in accordance with increasing angular divergence of light rays within said beam as measured away from said reflector plane of symmetry in planes orthogonal thereto such that the intensity of illumination of points, above and below a central axis in any said normal plane defined by the intersection of said reflector plane of symmetry and any said normal plane, is increased to compensate substantially exactly for natural losses in the intensity of direct illumination which would otherwise be present at those same points absent said reflector and to abruptly cause a reduction in the intensty of illumination of light traveling at angles away from said plane of symmetry, as measured in said plane orthogonal thereto, which exceed a predetermined value, said distribution of illumination in said normal plane along another axis thereof, perpendicular to said central axis thereof, being substantially constant therealong within said angular divergence of predetermined value.

5. The lighting assembly of claim 4 wherein the coefficients of said polynomial are given by:

$A_0=0.0$
$A_1=-1.0473509$
$A_2=6.074585$
$A_3=-20.471872$
$A_4=47.502146$
$A_5=-63.91636$
$A_6=45.333022$
$A_7=-13.07712$ where said polynomial is specified in a Cartesian coordinate system that has been rotated by 45° and $X \geqq 0$.

6. The assembly of claim 5 wherein said source has a radius of 0.05 inches and has its center located on said reflector plane of symmetry a distance of 0.040 inches forward of the apex of said reflector.

7. An improved reflector for use in an artificial lighting assembly having an artificial source of illumination of predetermined geometry, said improved reflector being a concave, open-ended type that is rotationally symmetric about a given axis and having a cross-sectional shape in the form of a 7th order polynomial curve given by the equation:

$$Y = \sum_{n=0}^{7} A_n X^n$$

where Y and X are, respectively, the dependent and independent variables in a Cartesian coordinate system and the terms, $A_n$, represent the coefficients of said polynomial, said polynomial curve having a radius of curvature, and hence optical power, which progressively changes in a gradual manner without discontinuities with distance along said curve, said curve being shaped so that the radius of curvature thereof increases with increasing distance from the apex thereof so as to reduce the optical power of said reflector in accordance with increasing distance along said curve and wherein said coefficients of said polynomial are given by:

$A_0=0.0$
$A_1=-1.0473509$
$A_2=6.074585$
$A_3=-20.471872$
$A_4=47.502146$
$A_5=-63.91636$
$A_6=45.333022$
$A_7=-13.07712$ where said polynomial is specified in a Cartesian coordinate system that has been rotated by 45° and $X \geqq 0$.

8. An improved reflector for use in an artificial lighting assembly having an artificial source of illumination of predetermined geometry, said improved reflector being a concave, open-ended type, bilaterally symmetric about a plane, said reflector being of given width and having a cross-sectional shape in the form of a 7th order polynomial curve given by the equation:

$$y = \sum_{n=0}^{7} A_n x^n,$$

where Y and X are, respectively, the dependent and independent variables in a Cartesian coordinate system and the terms, $A_n$, are the coefficients of said polynomial, said polynomial curve having a radius of curvature, and hence optical power, which progressively changes in a gradual manner with distance along said curve, said curve being shaped so that the radius of curvature thereof increases with increasing distance from the apex thereof so as to reduce the optical power of said reflector in accordance with increasing distance along said curve and wherein said coefficients of said polynomial are given by:

$A_0=0.0$
$A_1=-1.0473509$
$A_2=6.074585$
$A_3=-20.471872$
$A_4=47.502146$
$A_5=-63.91636$
$A_6=45.333022$
$A_7=-13.07712$ where said polynomial is specified in a Cartesian coordinate system that has been rotated by 45° and $X \geqq 0$.

* * * * *